United States Patent [19]

McFadden

[11] 4,082,279

[45] Apr. 4, 1978

[54] PHONEMIC WORD GAME METHOD

[76] Inventor: Robert L. McFadden, 105 Loller Rd., Hatboro, Pa. 19040

[21] Appl. No.: 696,867

[22] Filed: Jun. 17, 1976

[51] Int. Cl.[2] ..... A63B 67/06; G09B 19/22

[52] U.S. Cl. ..... 273/272; 35/35 H; 273/288; 273/100; 273/282

[58] Field of Search ..... 35/35 R, 35 H; 273/95 R, 96 B, 100, 101, 102 R, 104, 105 R, 106 B, 126 R, 127 R, 127 B, 130 E, 135 D, 135 B, 137 R

[56] References Cited

U.S. PATENT DOCUMENTS

| | | | |
|---|---|---|---|
| 810,631 | 1/1906 | Enos | 273/130 E UX |
| 1,501,942 | 7/1924 | Carman | 273/100 |
| 1,764,448 | 6/1930 | Herzfeld | 273/100 UX |
| 2,524,548 | 10/1950 | Speirs | 273/115 UX |
| 2,585,458 | 2/1952 | Gordon | 273/126 R |
| 2,852,863 | 9/1958 | Homan | 35/35 H X |
| 3,464,124 | 9/1969 | Lynd | 35/35 H |
| 3,573,869 | 4/1971 | Duckett | 273/95 R X |
| 3,766,668 | 10/1973 | Vogel | 35/35 H |
| 3,784,200 | 1/1974 | Hotchkiss | 273/106 R X |
| 3,815,915 | 6/1974 | Chapman | 273/105 R X |
| 3,990,703 | 11/1976 | Evans | 273/95 R |

*Primary Examiner*—Richard C. Pinkham
*Assistant Examiner*—Vance Y. Hum
*Attorney, Agent, or Firm*—Nelson E. Kimmelman

[57] ABSTRACT

An instructional game includes a game board on which there are a selected number of rows of pegs or pins protruding from the surface of the board. Associated with each pin is a phoneme in a particular language. Two sets of different rings are provided to the two teams or players. The player of one team encircles one peg and its associated phoneme with one of the rings of one set. A player of the opposite team encircles a different peg and its associated phoneme with a ring from the second set. This continues alternately until a player recognizes that he has completed the word when he encircles a particular phoneme whereupon that player or his team removes all the rings, capturing the rings of the opposing team or player. This continues until all of the adversary's rings are captured.

4 Claims, 3 Drawing Figures

PHONEMIC WORD GAME METHOD

BACKGROUND OF THE INVENTION

1. Field of the Invention

This invention relates to games and in particular to a board game that is useful for educational purposes or simply for the amusement of the players.

2. Prior Art

Word games are known such as those which involve the placing of lettered tiles having specific assigned numerical values in the unit areas of a playing board ("SCRABBLE"), or those in which letters are placed on the faces of cube shaped members. These cubes, like dice, are shaken up and spilled out on the board where each player has an allotted time to arrange them in intelligible combinations. However, no game is known in which very young children can be taught the rudiments of spelling and reading with the simplicity of the games to be described below. It is therefore among the objects of the present invention to provide a game which is instructional, simple, and capable of imparting pleasure to the players.

BRIEF SUMMARY OF THE INVENTION

A game which includes a game board having a playing surface having a plurality of game areas, each area being adapted to receive a single game piece and bearing selected phonemic indicia, each of said areas also having means for releasably confining one of said game pieces thereto. The game also includes a plurality of game pieces constructed to be releasably retained in said respective areas by one of said confining means associated therewith.

DETAILED DESCRIPTION OF THE DRAWINGS

Figure 1:
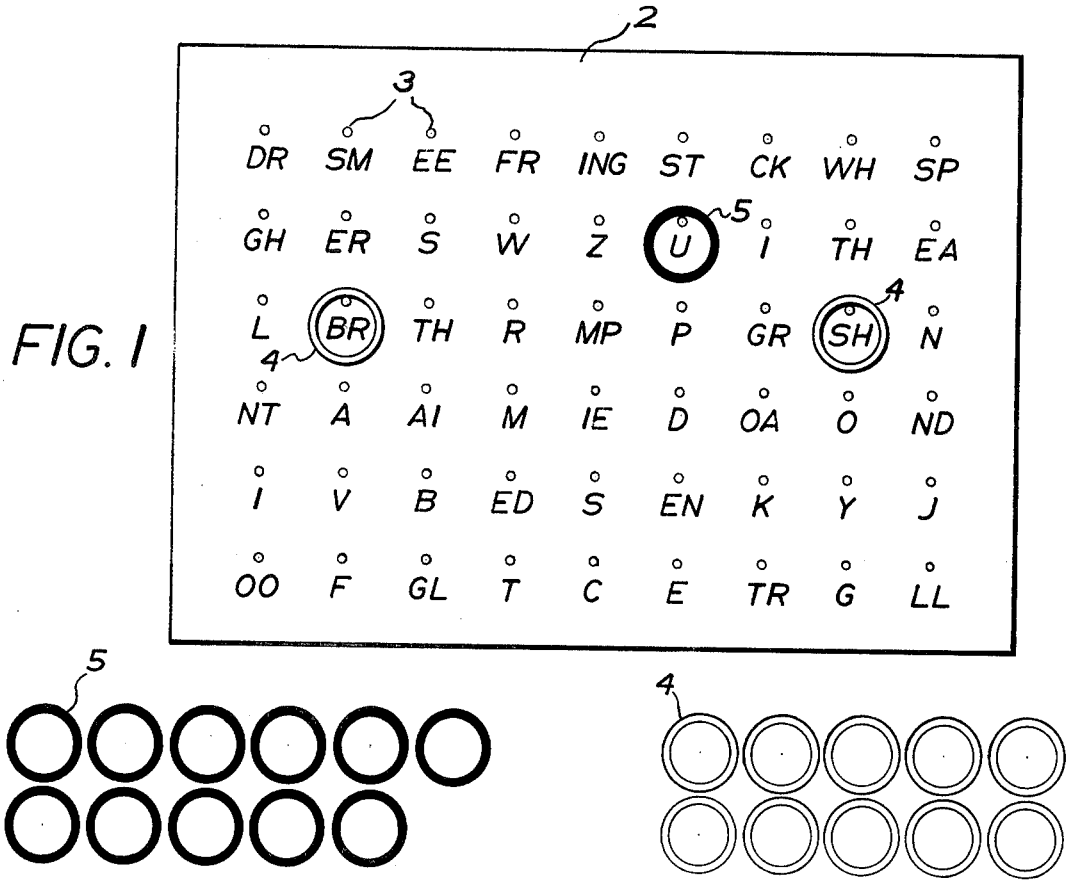
FIG. 1 is a plan view of a playing board and rings used in playing the present game.

FIG. 1 shows one form of the present invention comprising a board 2 made of any appropriate material such as wood, plastic, or paper board on which are mounted a plurality of pins, pegs or nails 3 in any number of rows. In FIG. 1 54 nails or pins 3 are arranged in horizontal rows of nine each. Beneath each pin there appears a phonemic element of the English (or other) language such as vowels, consonants or blends of both, or digraphs, or other combinations of letters. A phoneme is defined as the smallest unit of speech distinguishing one utterance from another. As shown, most of the phonemes are more than one letter in length.

Provided as game pieces are a number of rings 4 of a certain color and a corresponding number of rings 5 of a different color. The players are divided up into two or more teams, each team starting with the same number of rings, e.g., 12. The first player on the "A" team, which is equipped with the white rings 4, takes one ring and encircles any given phonemic element by placing that ring 4 around the peg or pin 3 associated with the "BR" digraph. Then it is the turn of the "B" team and one of their players puts one of the black rings 5 around a selected other pin-phonemic element combination such as the one having the letter "U". The next player of the "A" team takes a ring 4 and searches for a pin with a phoneme beneath it which will complete an English word. If that player encircles the pin with "SH" under it, the word "BRUSH" is completed. Therefore, the last-mentioned player may remove all the rings from the board including the black ring 5 belonging to the opposing "B" team. Of course, the game can be played with any desired minimum number of rings required to complete the word, i.e., from 2 rings upward.

Figure 3:
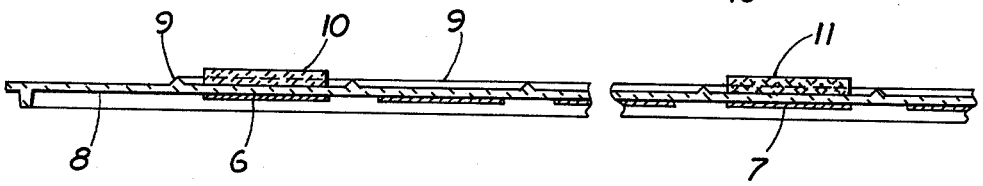
FIG. 3 is a sectional view of the apparatus in FIG. 2 taken along the section line 3—3.

Still another form of the invention is shown in FIG. 3 in which there is a board 8 made of a transparent or translucent plastic, for example. It has a number of square areas bordered by upraised ridges 9 formed in the plastic. On the under surface of each square area any selected phonemic element such as the element "BR" printed on the square piece 6 may be fastened adhesively. Alternatively, each phonemic element may be silk-screened or painted on the upper surface of each square area. The square piece 7 shown in FIG. 3 contains the printed vowel "U" and is also fixed adhesively to the lower surface of that square portion of the board.

Instead of two sets of rings, each player or team as the case may be is equipped with a number of transparent square game pieces having dimensions somewhat smaller than the dimensions of each square area so that they can be easily inserted or lifted out of each square area. Thus, the two square elements 10 are of one color whereas the square element 11 of the other team is of another color to allow for differentiation. The game is played substantially the same way as in the first embodiment except that the objective is to capture all of the opponent or opposing team's transparent game pieces 10 or 11 as the case may be.

Figure 2:
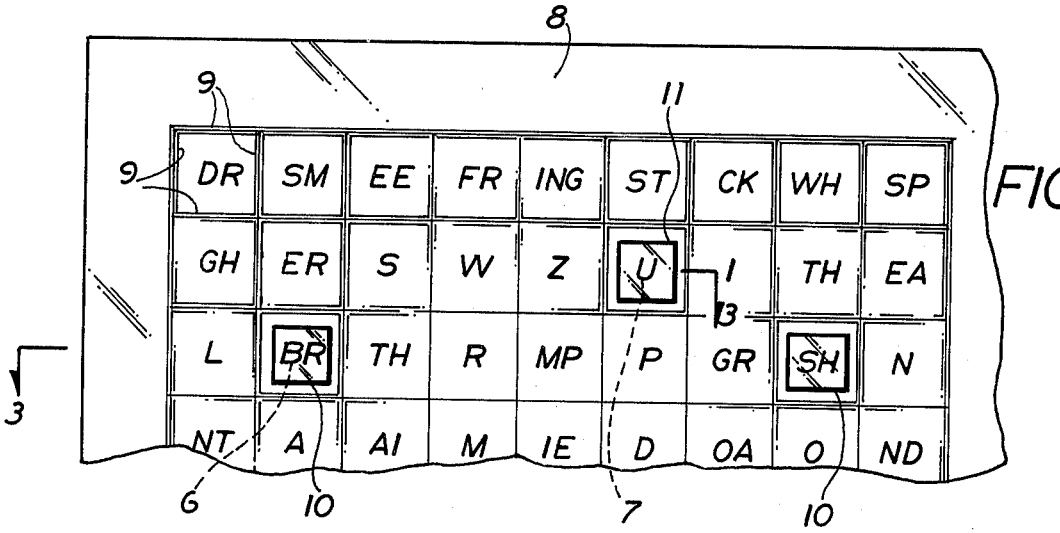
FIG. 2 is a fragmentary plan view of another type of board which embodies the present invention.

The size of the board and the number of phonemic elements appearing on it is determined by the degree of difficulty required. For younger children or players, the board may have only two dozen of the simplest phonemic elements to help them to begin to read. The form shown in FIGS. 1 and 2 have 54 elements, but a still more complex and difficult board may have, for example, over eighty advanced phonemic elements of the language.

Different lengths of games may also be devised. For example, if a shorter game is desired, a time limit may be imposed and then, at the end of the interval, the winner may be determined by finding out which player or team has the most number of captured rings or game pieces. In still another form, the game may be won as soon as a specified number, such as 4, 6, or 8 rings or pieces of the adversary are captured.

In another form, a board such as the one shown in FIG. 1 can be placed almost vertically and then the rings may be tossed toward it by each player who may aim at selected phonemes. The tossing of a ring around a pin associated with a phoneme which completes a word allows the tosser to obtain all of the rings around other pins and even rings which have failed to encircle any pin.

I claim:

1. A method of manipulating the playing surface of a game board by at least two players, said playing surface having a plurality of game areas, each of said areas being provided with selected phonemic indicia at least a plurality of which are less than word length, said indicia also being combinable agglutinatively with selectable others of said indicia to form words or parts of words larger than the constituent indicia, said board also being provided with means for releasably confining game pieces to respective ones of said areas, said method comprising:

(a) placing by a first player of one of said game pieces on a selected one of said areas for releasable confinement thereto, (b) then placing by another player, in his turn, of another of said game pieces on a selected other one of said areas for releasable confinement thereto, continuing, if necessary, the placement of additional game pieces on respective game areas by the players in turn until the phonemic indicia associated with at least some of said areas on which pieces have been placed constitute the phonemes of an intelligible word, and (d) thereupon removing by a player all of said placed game pieces and retaining them.

2. The method according to claim 1 wherein steps (a) through (d) are repeated until one player has retained all of the game pieces.

3. The method according to claim 1 wherein steps (a) through (d) are repeated until a specified time interval has elapsed.

4. The method according to claim 1 wherein steps (a) through (d) are repeated until one player has retained at least a predetermined number of said game pieces.

* * * * *